US008375519B1

(12) United States Patent
Cooper et al.

(10) Patent No.: US 8,375,519 B1
(45) Date of Patent: Feb. 19, 2013

(54) SIGNAL ACTIVATED DOOR HINGE

(76) Inventors: Darrell Glenn Cooper, Paso Robles, CA (US); Jose Carrillo, III, Duluth, MN (US)

( * ) Notice: Subject to any disclaimer, the term of this patent is extended or adjusted under 35 U.S.C. 154(b) by 374 days.

(21) Appl. No.: 12/460,984

(22) Filed: Jul. 27, 2009

(51) Int. Cl.
*E05D 11/10* (2006.01)

(52) U.S. Cl. ..... 16/319; 16/386

(58) Field of Classification Search ..... 16/319, 16/221, 223, 327–332, 341, 386; 160/188; 292/388, 342–343, DIG. 15
See application file for complete search history.

(56) References Cited

U.S. PATENT DOCUMENTS 3,117,340 A * 1/1964 Arboll ..... 16/303
3,559,232 A * 2/1971 Crane ..... 16/50
5,125,131 A * 6/1992 Leblanc ..... 16/330
5,408,726 A * 4/1995 Kent ..... 16/326
5,564,163 A * 10/1996 Lowry et al. ..... 16/342
5,774,938 A * 7/1998 Kent et al. ..... 16/332
2003/0204935 A1 * 11/2003 Kim ..... 16/280

* cited by examiner

*Primary Examiner* — Victor Batson
*Assistant Examiner* — Matthew Sullivan
(74) *Attorney, Agent, or Firm* — Walter Unterberg

(57) ABSTRACT

A Signal Activated Door Hinge is typically a three-hinge door's central hinge. The lower part of the hinge plates attaches to an upper sprocket pinned to a lower sprocket which supports a central drop shaft extending to the bottom of the cover tube. An annular drop weight slides on the drop shaft, latching to a pivoted release lever near the drop shaft top. A bi-metallic muscle wire controls the pivoted release lever. As electric signal reaches the muscle wire, the release lever rotates away from the drop weight which unlatches and slides down the drop shaft under gravity, impacting the bottom of the drop shaft and pulling it down to open the sprocket connections. A coiled spiral activation spring inside the upper sprocket unwinds, rotating a hinge plate. To reset, the signal is canceled and the drop weight raised to the latched position in the release lever.

4 Claims, 6 Drawing Sheets

SIGNAL ACTIVATED DOOR HINGE

BACKGROUND OF THE INVENTION

1. Field of the Invention

This invention relates to remotely activated door hinges. In particular it relates to normally openable hinges which close a door when activated by an electric signal.

2. Discussion of Related Art

Currently, a door which closes off part of a building 15 (such as a fire door), can be fitted with an external closing mechanism attached to the door to control opening and closing of the door. Usually such a mechanism closes an open door; or keeps a door fully open until a signal is received to close it. Lacking such a mechanism, a strategic fire door is usually kept closed at all times.

The present intent was to replace the external activating mechanism with one integral with an existing door hinge. Therefore, a search was undertaken in the U.S. patent literature for door controls and activated hinges. Eight patents were located:

U.S. Pat. No. 294,746 (1884) Lock Hinge

U.S. Pat. No. 853,588 (1907) Door Releasing Mechanism

U.S. Pat. No. 872,680 (1907) Automatic Releaser for Fire Doors

U.S. Pat. No. 1,540,647 (1925) Fire Door Control

U.S. Pat. No. 4,665,584 (1987) Buoyant Valve Member Closing Device for Doors

U.S. Pat. No. 5,408,726 (1995) Locking Device for Locking a Closure in an Open Position U.S. Pat. No. 5,727,348 (1998) Portable Remote Controlled Door Closer 0111831 (2004) Door Closer (Publication)

A review of these patents shows that apart from the 1884 patent, none of the inventions featured an integral hinge control mechanism. A novel design of an integral hinge 10 mechanism was therefore devised, the essentials of which are described in the Brief Summary Of The Invention which follows.

BRIEF SUMMARY OF THE INVENTION

This Signal Activated Door Hinge closes a door when activated by an external electrical signal, which can be from a fire alarm or other automatic device, or from manual activation. The hinge of the invention is typically installed as the central hinge of a standard three-hinge door. At its upper extremity it connects to standard hinge plates (one fastened to the wall and one to the door). Below the hinge plates a slim elongated cover tube houses the electro-mechanical components of the hinge.

The hinge plates are connected to three sprockets in series pinned to each other. The middle sprocket supports a slim central drop shaft ending in a protruding disk at its lower extremity. This disk is also the lower end of the hinge of the invention. Close to the upper end of the drop shaft a centrally pivoted release lever has a detent which in the readiness position supports an annular drop shaft weight around the drop shaft.

The release lever pivot position is controlled by a bi-metallic muscle wire looped through one end of the release lever. When heated by an electric current, the muscle wire changes length and so rotates the release lever. This current is supplied by external connector wires via screw-and-nut terminals attached to the cover tube.

In the readiness position a small electrical charge energizes the muscle wire which rotates the release lever about its pivot such that the release lever detent is in place to support the drop shaft weight. When an activation signal arrives via the connector wires, the small charge is interrupted and the muscle wire changes length, causing the release lever and its detent to move away from the drop weight to the release position.

The drop weight is now released to slide in free fall down the drop shaft until it impacts the drop shaft disk. In this activation position the impact pulls down the drop shaft which pulls down the middle sprocket, releasing the upper sprocket and connecting the middle sprocket to the lower sprocket.

A coiled spiral activation spring connected at one end to the hinge plate attached to the door, and at the other end to the middle sprocket, is thus free to uncoil and rotate this hinge plate to close the door.

To restore normal operation to the door and reset all devices to the readiness position, the activation signal is canceled so that the normal charge again flows through the muscle wire, pivoting the release lever to the readiness position. Next, the drop shaft disk is rotated and the drop shaft pulled up to its rest position. Lastly, a small tool is used to push up the drop weight to its readiness position, latched in the detent of the release lever. Everything is now in place for the next signal activation.

This invention is equally adaptable to a rated fire door and to a conventional interior residential door. The door can be closed by a signal from any position, such as fully or partly open or closed. The reset procedure is 10 simple and makes the door fully functional after an activation and ready for the next activation. Lastly, this invention avoids the cost, labor and inconvenience of existing external activation mechanisms.

BRIEF DESCRIPTION OP THE SEVERAL VIEWS OF THE DRAWING

A better understanding of the invention may be gained by reference to the Detailed Description which follows, in conjunction with FIGS. 1 through 6 which show the components of the Signal Activated Door Hinge and its method of operation.

In the drawing

DETAILED DESCRIPTION OF THE INVENTION

Figure 1:
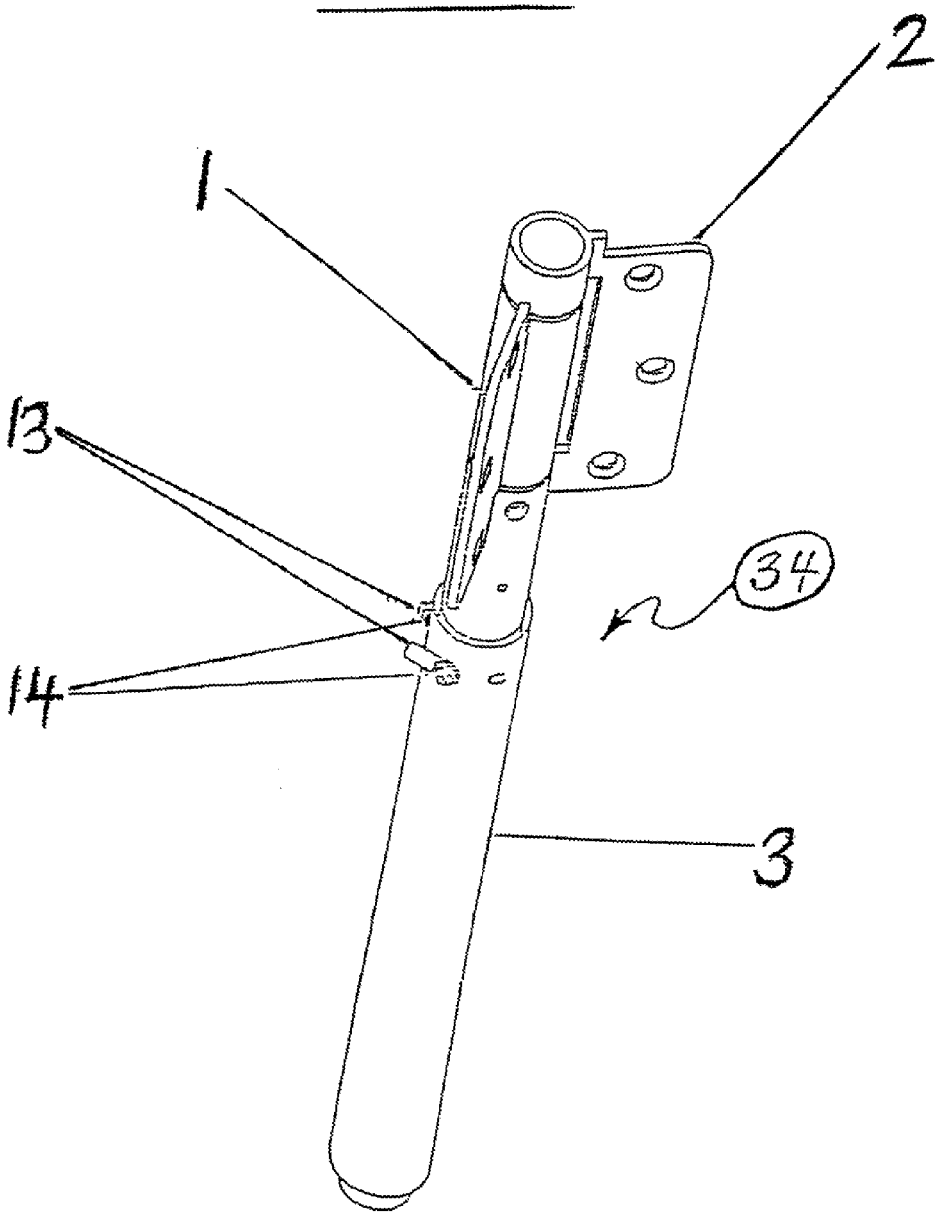
FIG. 1 is a pictorial external view of the assembled hinge of the invention.

Referring to FIG. 1, an pictorial external view of the assembled hinge of the invention, there are shown left hinge plate 1 and right hinge plate 2 for mounting complete hinge 34 to a door. Drop weight 4 (shown in FIGS. 3 and 4) is enclosed by cover tube 3 to which are attached a pair of screw and nut terminals 14 for receiving a pair of electrical connector wires 13 which carry the activation signal.

Figure 2:
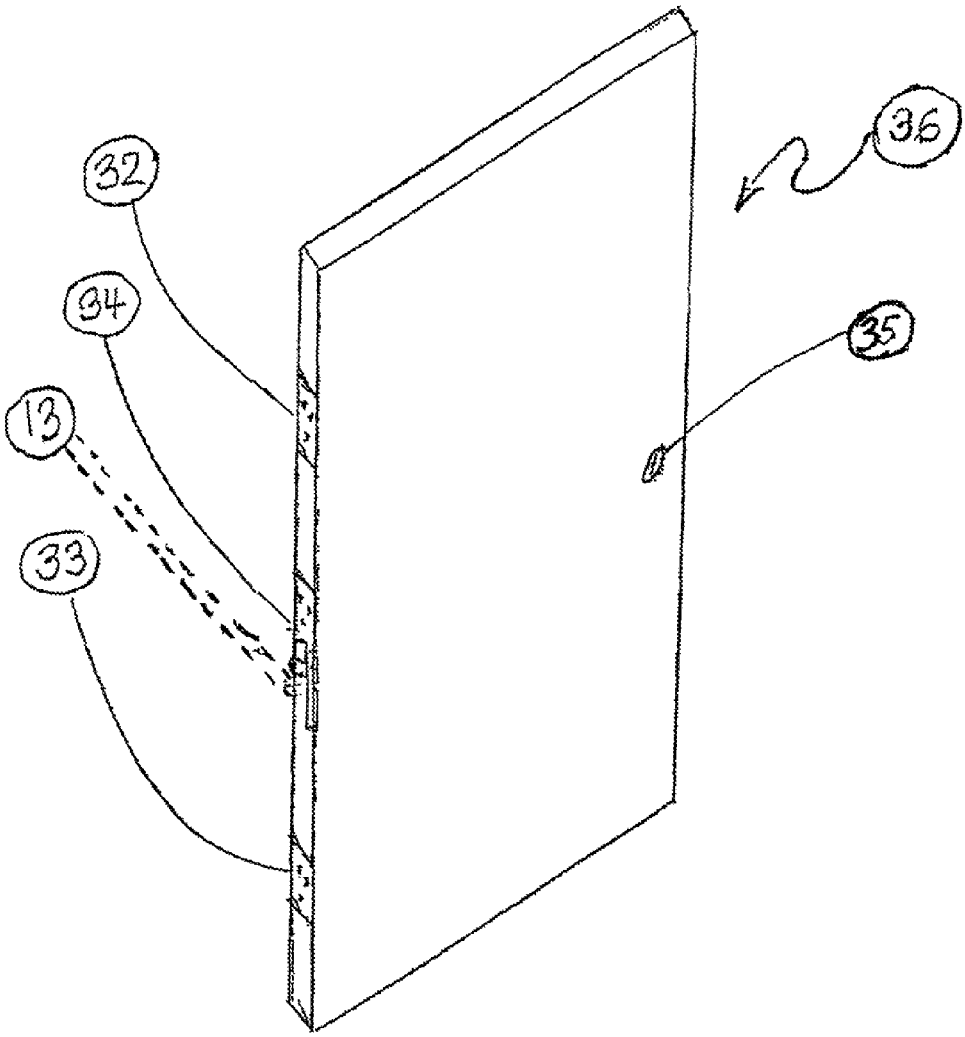
FIG. 2 is a pictorial view of a typical application of the invention to a standard passage door assembly.

Referring to FIG. 2, this is a typical application of the hinge of the invention to a standard passage door assembly 36, showing a pair of connecting wires 13, upper door hinge 32, lower door hinge 33, central signal activated door hinge 34 and door handle 35.

Figure 3:
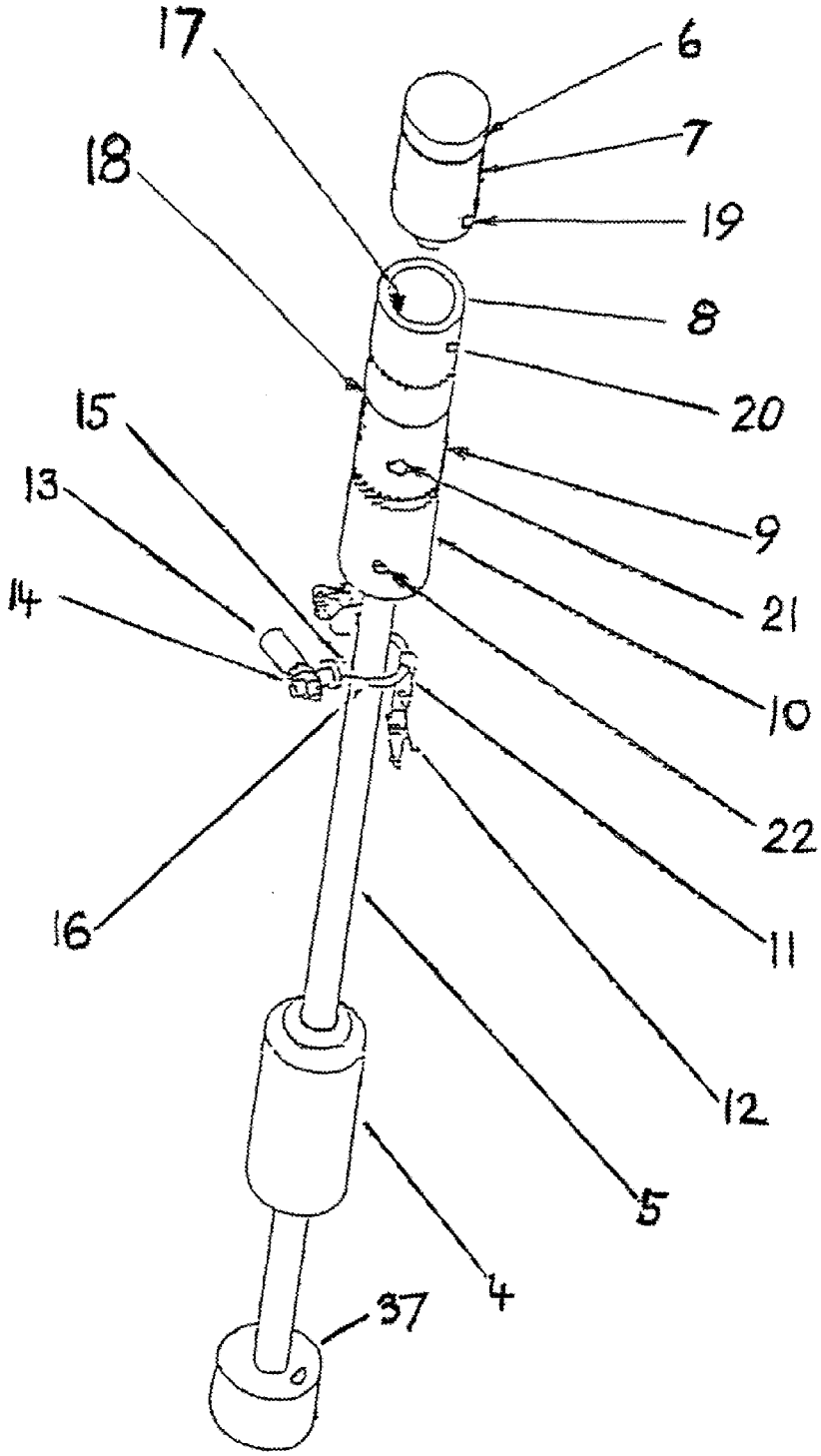
FIG. 3 is a pictorial view of the internal activation mechanism of the invention.

Referring to FIG. 3, this is a pictorial view of the internal activation mechanism of the invention with cover tube 3 removed. Shown are drop weight 4, drop shaft 5, upper pivot 6, upper bushing 7, upper sprocket 8, middle sprocket 9, lower sprocket 10, release lever 11, release lever spring 12, connector wires 13, screw and nut terminals 14, muscle wire 15, muscle wire cover tube 16, activation spring 17, lower bushing 18, pivot pin 19, upper pin 20, middle pin, 21, lower pin 22, and drop shaft disk 37.

Figure 4:
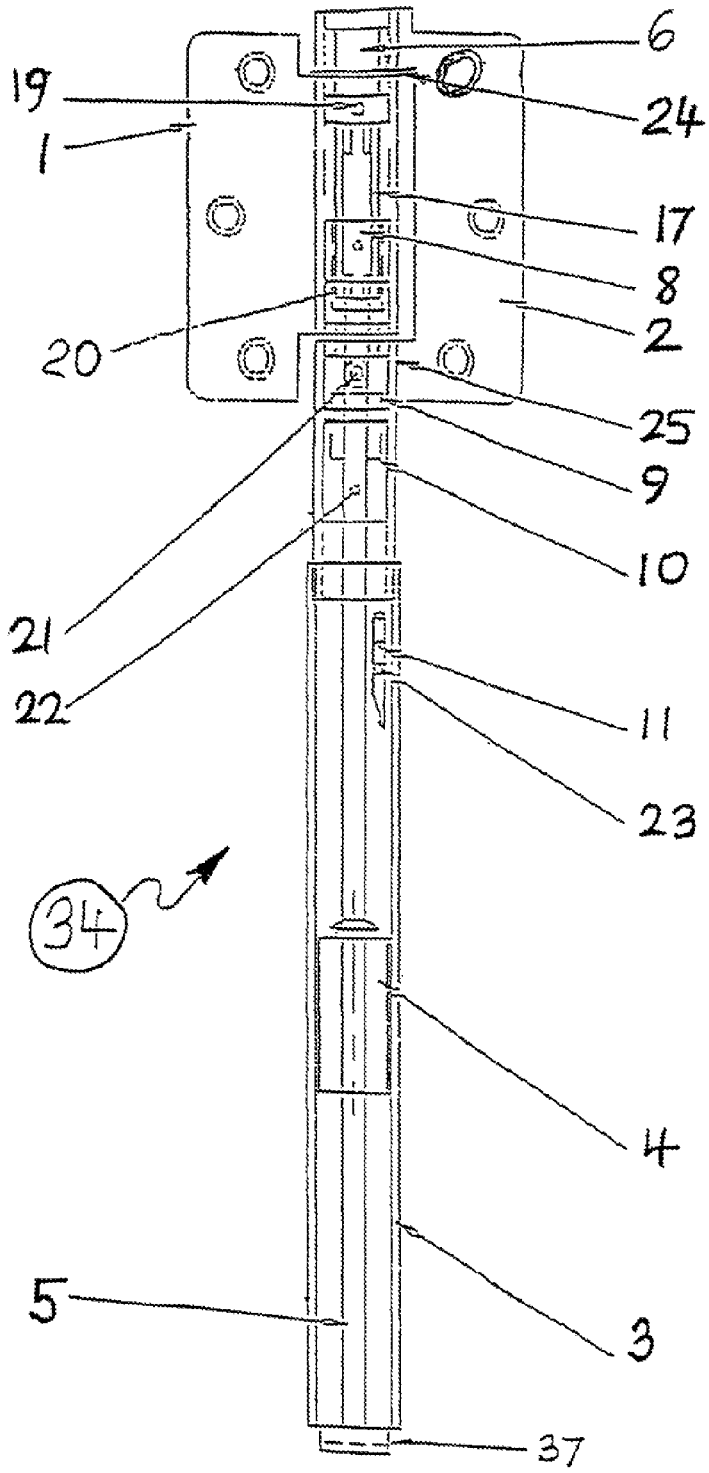
FIG. 4 is a cross-section of an elevation of the hinge of the invention, comparable to FIG. 1.

Referring to FIG. 4, this is an elevation of a cross-section of hinge of the invention 34, comparable to FIG. 1. Shown are left hinge plate 1, right hinge plate 2, cover tube 3, drop weight 4, drop shaft 5, upper pivot 6, upper bushing 7, upper sprocket 8, middle sprocket 9, lower sprocket 10, release lever 11, activation spring 17, pivot 5 pin 19, upper pin 20, middle pin 21, lower pin 22, release lever pin 23, upper washer 24, lower washer 25, and drop shaft disk 37.

Figure 5:
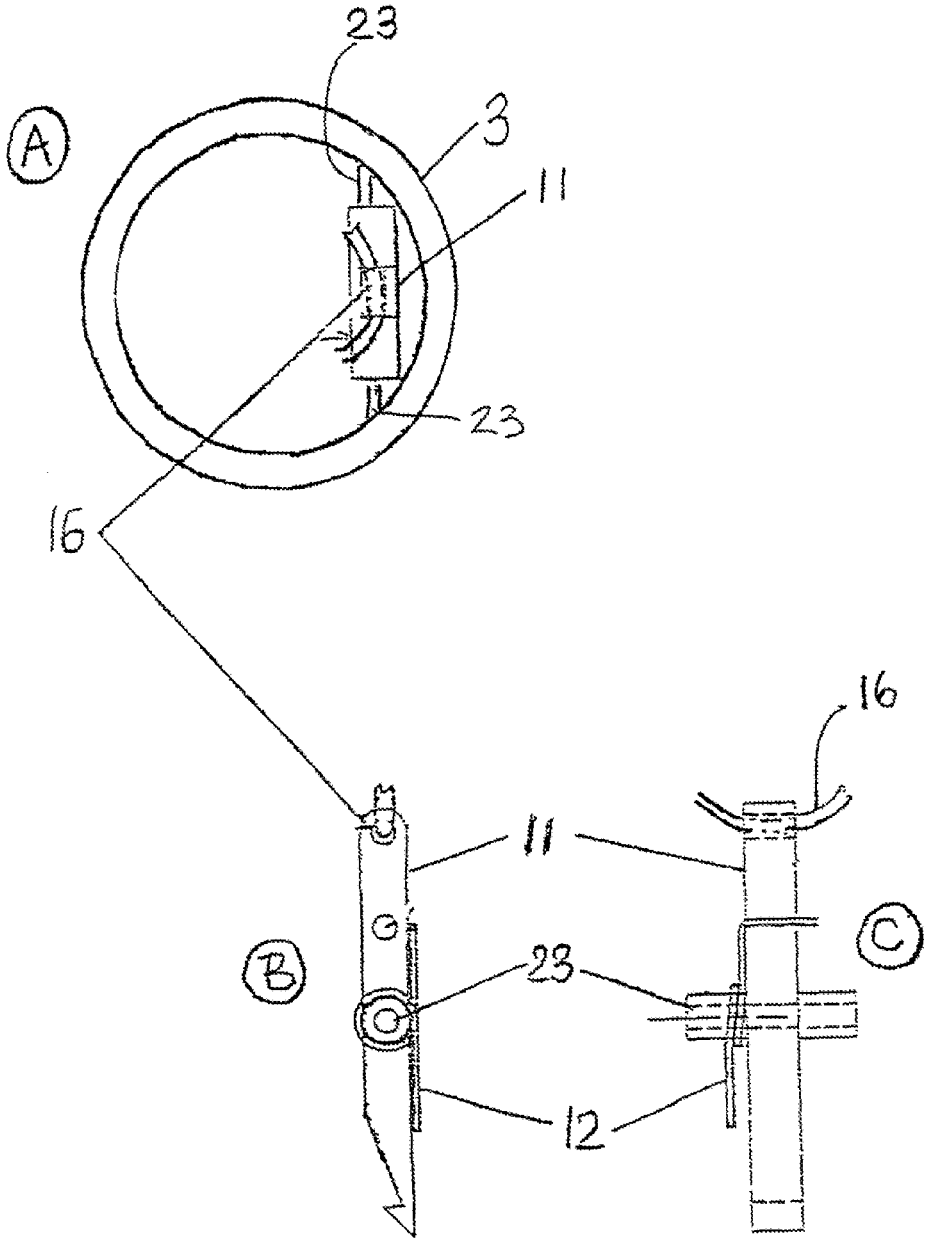
FIG. 5 is a three-view drawing of a drop weight release mechanism which activates the hinge.

Referring to FIG. 5, a three-view drawing of a drop weight release mechanism which activates the hinge, there are shown plan view A, elevation B, and side view C. The components shown are cover tube 3, release lever 11, release lever spring 12, muscle wire cover tube 16 (sheathing muscle wire 15, see FIG. 3) and release lever pin 23.

Figure 6:
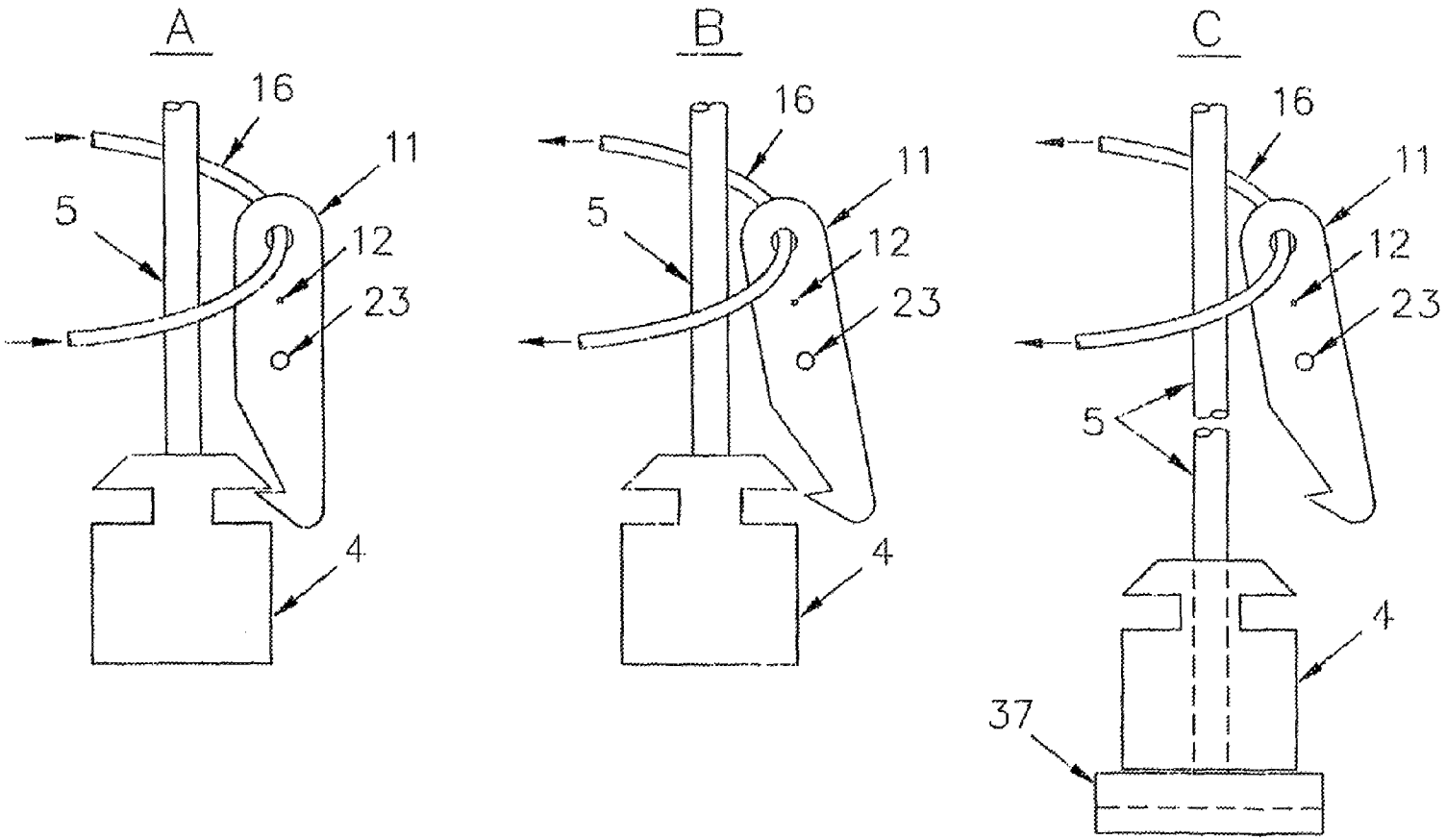
FIG. 6 is an elevational overview showing the drop weight release mechanism in three sequential positions: readiness-release-activation.

Referring to FIG. 6, this is an elevational drawing showing the drop weight release mechanism in three sequential positions during hinge activation: Ready position A, release position B, and activation position C. Components shown are drop weight 4, drop shaft 5, release lever 11, release lever spring 12, muscle wire tubing 16 (sheathing muscle wire 15), release lever pin 23, and drop shaft disk 37.

Interconnection of Components and Operation

In the usual application, hinge plates 1 and 2 attach the invention hinge 34 to a typical door and jamb assembly, preferably in a central position between upper and lower freely-turning hinges 32 and 33, as shown in FIG. 2. Cover tube 3 protectively covers the moving parts of invention 30 hinge 34. Drop weight 4 slides up and down drop shaft 5 which is suspended from upper pivot 6. Upper bushing 7 and lower bushing 18 turn freely and space other parts.

In the ready position, door 36 is fully opened and drop weight 4 is pushed upward to the top of drop shaft 5 by use of a small tool and latched in place by a detent in 5 release lever 11, which winds up associated release lever spring 12 (See FIG. 6A). For the detent in release lever 11 to reliably engage drop weight 4, lever 11 must be rotated about pivot pin 19 to its extreme clockwise position (shown as vertical in FIG. 6A).

This is achieved by electrically energizing muscle wire 15 (in cover tube 16) via connector wires 13 and terminals 14. When a small electrical charge is thus applied to energize muscle wire 15, which is looped through a hole in the upper extremity of lever 11, muscle wire heats up and expands to rotate lever 11 clockwise to its extreme (vertical) position (see FIG. 6A) when its detent latches drop weight 4 in place. In this configuration invention hinge 34 functions as a standard hinge, allowing door 36 to be opened and closed in normal use.

Muscle wire is a common name for a bi-metallic wire which changes length when heated by an electric current. Muscle wires are sold by a number of vendors and come in a variety of diameters to suit the application. A typical model for the present invention would be Flexinol® 0.015 sold by Images Scientific Instruments Inc, Staten Island, N.Y. The diameter of this model is 0.015 inch.

To close door 36, an electrical signal, typically from a smoke alarm, is transmitted to connector wires 13. This interrupts the small charge and causes muscle wire 15 to contract and move to the left, rotating lever 11 away from drop weight 4 to unlatch drop weight 4 (FIG. 6B, Release). As a result drop weight 4 falls down drop shaft 5 under gravity, and impacts drop shaft disk 37 connected to drop shaft 5 (FIG. 6C—activation).

This pulls down drop shaft 5 whose upper extremity is pinned by middle pin 21 to middle sprocket 9. As a result middle sprocket 9 pulls down and away from upper sprocket 8 and connects to lower sprocket 10.

Now coiled spiral activation spring 17, located within sprockets 8 and 9, is attached at its fixed end to upper pivot 6 which is connected by pivot pin 19 to left hinge plate 1 which is affixed to the stationary frame of door 36. The active end of spring 17 is attached to middle sprocket 9 which as a result of activation (as described above) becomes connected to lower sprocket 10 which is attached by lower pin 22 to right hinge plate 2 affixed to movable door 36.

Spring 17 is now free to uncoil and release its stored energy through its active end via lower sprocket 10 and right hinge plate 2 to close door 36.

After an activation, as described above, invention hinge 34 is re-set for the next activation. This is done by canceling the activation signal, fully opening door 36 manually, rotating drop shaft disk 37 to its original position, and, as before, using a small tool to push drop weight 4 to the top of drop shaft 5 until release lever 11 latches drop weight 4 in place. Then a small electrical charge is again supplied via connectors 13 and terminals 14 to keep drop weight 4 in place. Door 36 can then be opened and closed in normal use until the next activation.

ADVANTAGES OF THE INVENTION

1. Provides an integrated door hinge mechanism equally adaptable to a rated fire door and to a conventional interior residential door;
2. Avoids inconvenience of and installs with less labor time than existing external activation mechanisms;
3. Closes a door from any position—fully open, partly open, closed—when activated by a signal;
4. Incorporates a simple reset feature to make door fully functional after an activation and prepare it for another activation; and
5. Allows door to operate unrestricted without unsightly visible hardware until hinge is activated.

It is to be understood that the invention may be realized with embodiments differing from the specific devices disclosed herein without departing from the scope of the present invention as delineated in the following claims.

We claim:

1. In a signal activated door hinge for remotely closing a door by a low voltage electric signal, said signal activated door hinge comprising:

(a) an internal mechanical activation mechanism, (b) a left hinge plate connected to said internal mechanical activation mechanism and affixed to a stationary door frame; (c) a right hinge plate connected to said internal mechanical activation mechanism and affixed to a movable door; (d) a cylindrical cover tube surrounding and connected to said internal mechanical activation mechanism; and (e) external low voltage electrical wiring attached to said cover tube and further connected to said internal mechanical activation mechanism; whereby an external low voltage electrical charge applied to said external low voltage electrical wiring maintains said internal mechanical activation mechanism in a readiness mode, and a subsequent low voltage electric activation signal applied to said external low voltage electrical wiring interrupts said electrical charge, thereby converting said readiness mode to an activation mode whereby said internal mechanical activation mechanism moves said right hinge plate to close said movable door:

The internal mechanical activation mechanism comprising:

an upper pivot;

an upper bushing adjacent to said upper pivot;

an upper sprocket adjacent to said upper bushing;

a lower bushing adjacent to said upper sprocket;

a middle sprocket adjacent to said lower bushing;

an activation spring attached to inner surfaces of said upper sprocket and said middle sprocket;

a lower sprocket attached to said right hinge plate adjacent to said middle sprocket; and a drop shaft assembly attached to said middle sprocket.

2. The internal mechanical activation mechanism of claim 1 wherein said drop shaft assembly comprises a drop shaft suspended from said middle sprocket;

a drop shaft disk with a vertical hole attached to a lower extremity of said drop shaft;

a drop weight slidably attached to said drop shaft;

a release lever pivoting around a release lever pin attached to said cover tube, said release lever secured to said release lever pin by a release lever spring and having a detent for supporting said drop weight in a readiness mode; and a muscle wire loop insulated by a muscle wire cover tube, electrically connected to said screw and nut terminals and looped through said pivoting release lever at an upper extremity of said release lever.

3. A method for activating the internal mechanical activation mechanism of claim 2 from a readiness mode, said method comprising sending a said low voltage electrical activation signal to interrupt said external electrical charge to said insulated muscle wire loop, whereby said muscle wire loop contracts, pivoting said release lever to move said detent away from supporting said drop weight, causing said drop weight to slide under gravity down said drop shaft and impact said drop shaft disk, causing said drop shaft to pull down, causing attached said middle sprocket to pull down away from said upper sprocket and connect to said lower sprocket, thereby transferring stored energy from said activation spring via said lower sprocket to attached said right hinge plate, causing said attached movable door to close.

4. A method for resetting the internal mechanical activation mechanism of claim 2 after activation back to a readiness mode, said method comprising the steps of (a) canceling the activation signal;

(b) restoring the external electrical charge to pivot the release lever back to readiness with its detent ready to support the drop weight;

(c) with the movable door fully open, using a slotted screw driver to twist the drop shaft disk half a turn (180 degrees) to the right;

(d) pushing up on the drop shaft disk to tension the activation spring and supply its stored energy; and (e) inserting a push tool into the bottom of a vertical hole of the drop shaft disk and pushing the drop weight upward until it engages the detent of the release lever in the readiness mode.

* * * * *